United States Patent [19]

Siems

[11] Patent Number: 4,848,369

[45] Date of Patent: Jul. 18, 1989

[54] METHOD OF AND MACHINE FOR SIMULTANEOUSLY MAKING TWO OR MORE RODS FROM FIBROUS MATERIAL

[75] Inventor: Wolfgang Siems, Hamburg, Fed. Rep. of Germany

[73] Assignee: Körber AG, Hamburg, Fed. Rep. of Germany

[21] Appl. No.: 173,238

[22] Filed: Mar. 24, 1988

[30] Foreign Application Priority Data

Mar. 28, 1987 [DE] Fed. Rep. of Germany ..... 3710352

[51] Int. Cl.[4] ..... A24C 5/18

[52] U.S. Cl. ..... 131/84.4; 131/84.1; 131/906

[58] Field of Search ..... 131/84.1, 84.4, 906

[56] References Cited

U.S. PATENT DOCUMENTS

| | | | |
|---|---|---|---|
| 4,063,563 | 12/1977 | Lorenzen . | |
| 4,190,061 | 2/1980 | Heitmann et al. . | |
| 4,236,534 | 12/1980 | Heitmann et al. . | |
| 4,372,326 | 2/1983 | Serganoli | 131/84.1 X |
| 4,423,742 | 1/1984 | Reuland | 131/906 X |
| 4,463,767 | 8/1984 | Seragnoli | 131/84.4 X |
| 4,556,071 | 12/1985 | Hoffmann | 131/906 X |
| 4,574,816 | 3/1986 | Rudszinat | 131/906 X |
| 4,697,603 | 10/1981 | Steinhauer et al. | 131/84.4 |

*Primary Examiner*—V. Millin
*Assistant Examiner*—Robert W. Bahr
*Attorney, Agent, or Firm*—Peter K. Kontler

[57] ABSTRACT

A machine wherein a mobile partition divides a flow of tobacco particles into several streams each of which carries a surplus of tobacco particles. The surplus is removed from the streams by discrete trimming devices to convert the streams into fillers which are draped into webs of cigarette paper. The removed surplus is measured independently for each stream and the signals which are generated to denote the quantities of removed surplus are used to change the position of the partition in a sense to ensure that each stream contains a predetermined quantity of surplus. A device which monitors the density of at least one filler generates signals serving to adjust the trimming devices in a sense to ensure that the density of all fillers matches a preselected density.

26 Claims, 2 Drawing Sheets

METHOD OF AND MACHINE FOR SIMULTANEOUSLY MAKING TWO OR MORE RODS FROM FIBROUS MATERIAL

BACKGROUND OF THE INVENTION

The invention relates to a method of and to a machine for simultaneously making two or more rods from fibrous material, especially from particles of natural, reconstituted and/or substitute tobacco. More particularly, the invention relates to improvements in methods and in machines of the type wherein a single flow of fibrous material is subdivided into several streams each of which is relieved of the surplus, if any, and is thereupon draped into a web of cigarette paper, imitation cork or other suitable wrapping material.

Machines which are capable of simultaneously making at least two rods of fibrous material are known for many years. Reference may be had, for example, to U.S. Pat. No. 4,463,767 which describes and shows a continuous twin rod making machine. The patent proposes to measure the quantity of tobacco particles in each stream prior to removal of the surplus, and to use the thus obtained signals for an adjustment of the partition which is employed to divide a single flow of tobacco particles into two discrete streams. This means that the position of one trimming device relative to the respective stream of tobacco particles can be different from the position of the other trimming device with respect to the corresponding tobacco stream. Consequently, even though the patented machine can ensure that the density of each stream matches or closely approximates a selected value, the characteristics of the rods which are obtained in such machines can deviate from each other. Furthermore, the quantity of surplus material in one of the streams can be different from the quantity of surplus tobacco in the other stream. On the other hand, it is desirable and advantageous to ensure that all characteristics of both streams, as well as of the rods which are obtained from such streams, be the same or should not appreciably deviate from each other.

OBJECTS AND SUMMARY OF THE INVENTION

An object of the invention is to provide a novel and improved method of simultaneously producing several rods of fibrous material, particularly tobacco, in such a way that the characteristics of the rods are not only similar to but actually match or at least very closely approximate each other.

Another object of the invention is to provide a method which renders it possible to produce at least two identical rods of fibrous material and to maintain the densities, diameters and other desirable characteristics of all rods close to or actually at the desired optimum value.

A further object of the invention is to provide a novel and improved method of measuring the quantities of surplus fibrous material which are removed from several streams of such material in a rod making machine serving to turn out several rods in a simultaneous operation.

An additional object of the invention is to provide a method which ensures that any deviations from optimum characteristics of two or more simultaneously produced rods of fibrous material are eliminated or compensated for within short intervals of time so that the quality of ultimate products does not deviate from an acceptable value as well as that the number of rejects is reduced to a minimum.

Still another object of the invention is to provide a novel and improved machine for the practice of the above outlined method and to construct and assemble the machine in such a way that it can turn out two or more identical rods of fibrous material in a simultaneous operation.

A further object of the invention is to provide the machine with novel and improved means for measuring the surplus of fibrous material which is removed from several discrete streams of fibrous material preparatory to conversion of such streams into rods, especially rods of comminuted tobacco.

Another object of the invention is to provide the machine with novel and improved means for processing and utilizing signals which are generated to indicate the quantities of surplus of fibrous material in several simultaneously advancing streams which are about to be converted and which are being converted into rods ready for draping into webs of cigarette paper or the like.

A further object of the invention is to provide the machine with novel and improved means for adjusting the device or devices which are employed to subdivide a single flow or stream of fibrous material into a plurality of smaller streams.

Another object of the invention is to provide the machine with novel and improved means for regulating the operation of the surplus removing devices.

One feature of the present invention resides in the provision of a method of simultaneously producing at least two rods from fibrous material of the tobacco processing industry, especially a plurality of tobacco rods from the making of cigarettes. The method comprises the steps of forming a single flow of fibrous material, subdividing the flow into a plurality of streams each of which contains a surplus of fibrous material, removing the surplus from each of the streams to thus convert the streams into rod-like fillers, measuring the quantities of removed surplus of fibrous material for each stream and generating so-called surplus signals which denote the removed quantities of surplus fibrous material, comparing the signals, and varying the subdividing step when the signals differ from each other until each of the stream as contains a predetermined quantity of surplus material. The method preferably further comprises the step of draping each filler into a web of cigarette paper or other suitable flexible wrapping material.

The method can also comprise the steps of monitoring the density of at least one of the fillers and generating a second (density) signal which denotes the density of the at least one filler, and varying the removal of surplus from the respective stream as a function of changes of the second signal. Alternatively, the second or density signal can be utilized to synchronously vary the removal of surplus from al of the streams as a function of changes of such second signal. It is further within the purview of the invention to measure the density of each filler and generate second signals which denote the densities of the respective fillers, and changing the surplus removing step as a function of changes of the respective second signals so that all of the fillers exhibit identical densities. Each second signal can be compared with a single predetermined reference signal, and the rate of removal of surplus from a stream is changed when the respective second signal deviates from the reference signal.

The measuring step can include measuring the density of each stream prior and subsequent to removal of the surplus (i.e., measuring the density of each untrimmed stream as well as the density of each filler) and generating first and second signals respectively denoting the densities prior and subsequent to removal of the surplus, and converting the first and the respective second signals into the aforementioned surplus signals including forming quotients or differences of the first and the respective second signals.

The step of varying the subdividing step can include forming additional signals which denote differences between the surplus signals, and utilizing the additional signals to divide the flow into streams. For example, the subdividing step can include breaking up the flow into two or more streams in such a way that the streams contain identical quantities of surplus.

Another feature of the present invention resides in the provision of a machine for simultaneously producing at least two rods from fibrous material of the tobacco processing industry, especially for simultaneously producing a plurality of tobacco rods for the making of cigarettes. The machine comprises means (such as a distributor or hopper) for building a single flow of fibrous material, adjustable means for subdividing the flow into a plurality of streams each of which contains a surplus of fibrous material, means for conveying the streams along discrete paths in predetermined directions, discrete means for removing the surplus from each of the streams in predetermined portions of the respective paths to thus convert the streams into rod-like fillers, means for measuring the quantities of removed surplus including means for generating so-called "surplus" signals denoting the removed quantities of fibrous material, and means for adjusting the subdividing means as a function of the surplus signals until each of the streams contains a predetermined quantity of surplus. The machine further comprises means for draping the fillers into webs of wrapping material.

The adjusting means includes means for comparing the surplus signals and for generating additional signals which denote the differences between the surplus signals, and means (such as a servomotor) for utilizing the additional signals for actual adjustment of the subdividing means. The comparing means can comprise a differentiating circuit or a quotient forming circuit.

The surplus removing means are preferably adjustable, and the machine then preferably further comprises means for monitoring the densities of fillers downstream of the respective surplus removing means and for generating so-called "density" signals which denote the densities of the respective fillers, and means for adjusting the surplus removing means as a function of changes of the respective density signals so that all of the fillers exhibit identical or practically identical densities. The monitoring means can comprise a discrete density monitoring device for each of the fillers, and the means for adjusting the surplus removing means can include at least one source of reference signals, means for comparing the density signals with reference signals from the source, and means for changing the rate of removal of surplus by the respective surplus removing means when density signals from a discrete density monitoring means deviate from the reference signals. The means for adjusting the surplus removing means can comprise a single source of reference signals which is common to all of the comparing means. The arrangement may be such that the monitoring means comprises means for monitoring the density of one of the fillers and for generating density signals which denote the density of the one filler, and means for adjusting all of the surplus removing means as a function of changes of density signals from such single monitoring means.

Each of the measuring means can comprise a first and a second detector. The first detector monitors the density of the respective stream and the second detector monitors the density of the respective filler. The first and second detectors respectively generate first and second signals which denote the densities of the respective stream and of the respective filler. Such machine further comprises a discrete signal comparing stage which is connected with the first detector and the respective second detector of a measuring means and serves to generate the corresponding surplus signal. Such measuring means can further comprise means for comparing the surplus signals and for transmitting to the adjusting means for the subdividing means additional signals which denote the differences between the surplus signals. The means for comparing the surplus signals can comprise a quotient forming circuit.

At least one of the detectors can comprise a source of infrared light which is directed against the respective stream or filler. The means for building the flow can include an adjustable component (such as a variable-speed particle propelling roller) which is operative to vary the quantity of fibrous material in the flow, and such machine further comprises means for adjusting the component in response to signals from at least one of the signal comparing stages so that the flow and the streams contain at least predetermined minimum quantities of surplus.

The means for monitoring the density of at least one of the fillers and for generating the aforementioned density signals denoting the monitored density can comprise a source of beta rays or a source of X-rays, and such machine further comprises means for adjusting at least one of the surplus removing means in response to variations of density signals which are generated with assistance from beta rays or X-rays.

The adjusting means for the subdividing means can include means for effecting a subdivision of the flow into equal streams through the medium of the subdividing means. Such subdividing means can include a pivotable flap which is installed in the path of the flow and can be shifted about its pivot axis so as to divert a larger or a smaller quantity of fibrous material into the paths for the individual streams of fibrous material.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
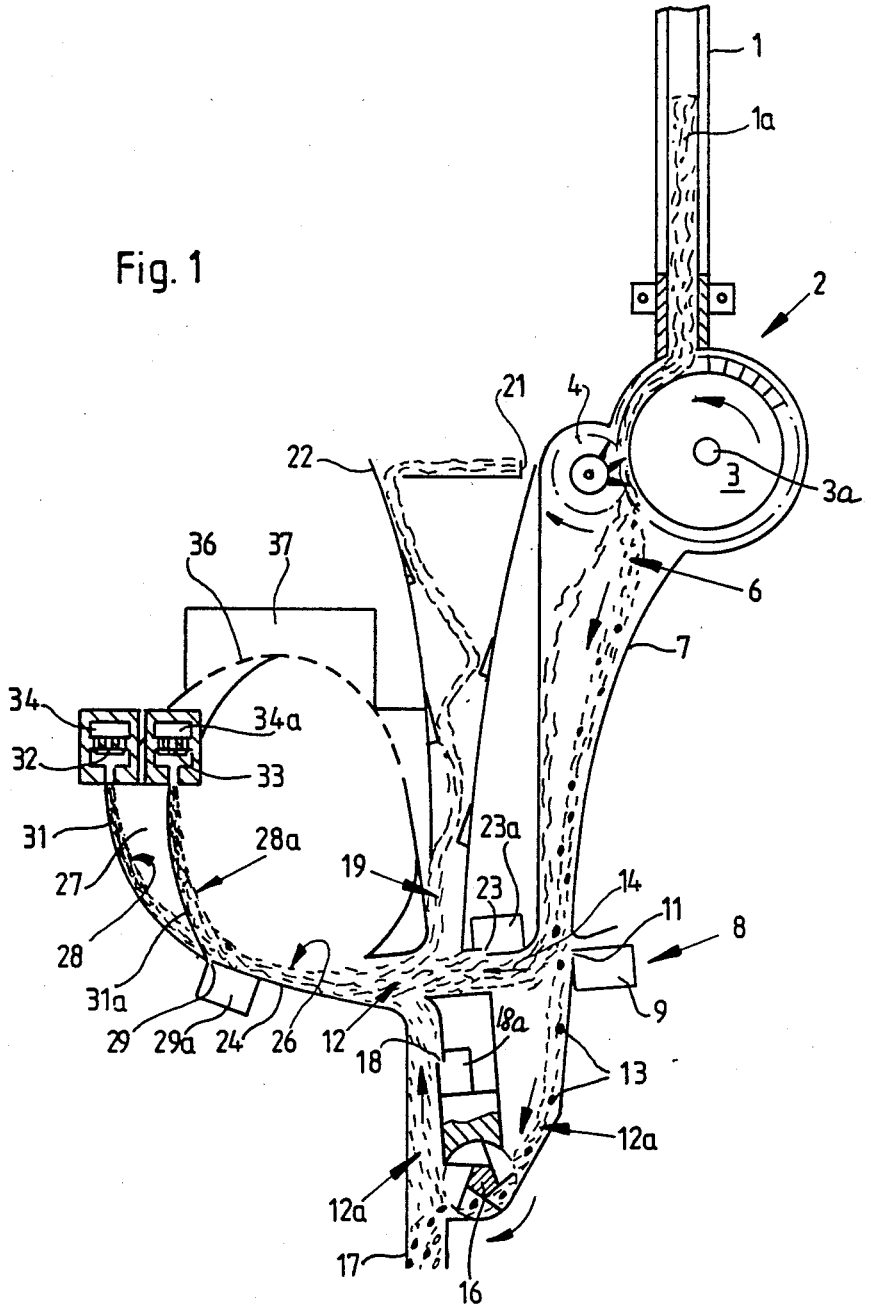
FIG. 1 is a vertical sectional view of that portion of a cigarette rod making machine which serves to build a single flow of fibrous material and to subdivide the flow into a plurality of separate streams each of which is conveyed at right angles to the plane of FIG. 1.

Referring first to FIG. 1, there is shown a portion of a cigarette rod making machine which is designed to simultaneously turn out two continuous rods of comminuted tobacco, for example, shredded tobacco leaf laminae. The part of the rod making machine which is shown in FIG. 1 constitutes a means for building a single flow 26 of fibrous material, and such flow building means comprises an upright duct 1 which contains a supply 1*a* of fibrous material, for example, a mixture of fragmentized tobacco ribs and tobacco shreds. The lower end portion of the duct 1 is adjacent a withdrawing unit 2 which includes a first component in the form of a carded drum 3 having means for withdrawing a continuous layer of tobacco particles from the lower end of the duct 1, and a second component in the form of a rapidly rotating picker roller 4 which expels the particles from the carding of the drum 3 and forms a shower 6 which descends in a downwardly tapering funnel-shaped duct 7. The shaft 3*a* which drives the drum 3 of the withdrawing unit 2 can be rotated at a plurality of different speeds so as to alter the rate at which fibrous material is being withdrawn from the duct 1 to be transferred into the duct 7.

The lower portion of the duct 7 cooperates with an accelerating device 8 including a plenum chamber 9 having one or more orifices 11 serving to discharge one or more jets of compressed air in the direction which is indicated by arrow 14. The jet or jets or air issuing from the chamber 9 divert or deflect lighter particles 12 in the direction of the arrow 14 while the heavier particles 13 (such as fragments of tobacco ribs) traverse the jet or jets of compressed air and continue to descend toward a rotating cell wheel gate 16. The plenum chamber 9 can be said to constitute a classifying device which serves to segregate lighter particles 12 from the heavier particles 13.

As a rule or at least in many instances, the heavier particles 13 entrain some of the lighter particles (12*a*) so that such lighter particles escape through the cell wheel gate 16 to enter a downwardly extending channel 17. This channel serves for recovery of lighter particles 12*a* in that its upper end portion receives one or more jets of compressed air from one or more orifices 18 provided in a plenum chamber 18*a*. The jet or jets of air issuing from the orifice or orifices 18 flow substantially upwardly so that they produce a venturi effect with the result that the lighter particles 12*a* rise in the channel 17 and merge into the main stream of lighter particles 12 which advance in the direction of the arrow 14 and are further accelerated by one or more jets of compressed air issuing from one or more orifices 23 provided in a further plenum chamber 23*a* of the flow building means shown in FIG. 1. The plenum chamber 18*a* acts not unlike an injector which does not interfere with evacuation of heavier particles 13 through the lower end of the channel 17 but enables the lighter particles 12*a* to rise and to merge into the flow of particles 12 so that the particles 12 and 12*a* jointly form the relatively wide single flow 26 advancing along the upper side of a supporting member 24 in a direction toward a subdividing device 27 in the form of a pivotable partition or flap having a substantially wedge-shaped outline. The flow 26 further contains particles of fibrous material 19 which is delivered by a vibratory trough-shaped conveyor 21 and a downwardly tapering funnel-shaped duct 22. The fibrous material 19 which is delivered by the conveyor 21 and duct 22 constitutes the combined surplus of fibrous material which is removed from two discrete streams 28 and 28*a* of fibrous material further downstream in the machine which embodies the structure of FIG. 1. The orifice or orifices 23*a* of the plenum chamber 23 are oriented to accelerate all of the particles which form the single flow 26 so that such particles advance at a predictable speed toward and along the upper side of the supporting member 24. The flow 26 is actually a mixture of fibrous material and conveying air, and such mixture closely hugs and advances along the upper side of the supporting member 24 to be accelerated again by one or more jets of compressed air issuing from the orifice or orifices 29 of an additional plenum chamber 29*a* at the tip of the partition 27. The purpose of the partition 27 is to subdivide the flow 26 into the aforementioned streams 28 and 28*a*. The stream 28 advances along a concave plate-like support 31 which is an extension of the supporting member 24, and the stream 28*a* advances along a support 31*a* which is or can be a component part of the pivotable partition 27. The supports 31 and 31*a* define two separate paths along which the streams 28 and 28*a* advance toward the undersides of two discrete conveying means 32, 33 each of which preferably constitutes an endless foraminous belt conveyor. The upper sides of lower reaches of the conveyors 32, 33 are adjacent the perforated bottom walls of two separate suction chambers 34, 34*a* which serve to attract the streams 28, 28*a* to the undersides of the lower reaches of the respective belt conveyors so that the streams 28 and 28*a* then advance along two substantially horizontal paths extending at right angles to the plane of FIG. 1. The surplus of conveying air which is admitted by plenum chambers 9, 18*a*, 23*a*, and 29*a* is permitted to pass through a sieve 36 and to enter an expansion chamber 37 prior to being discharged into the surrounding atmosphere.

Figure 2:
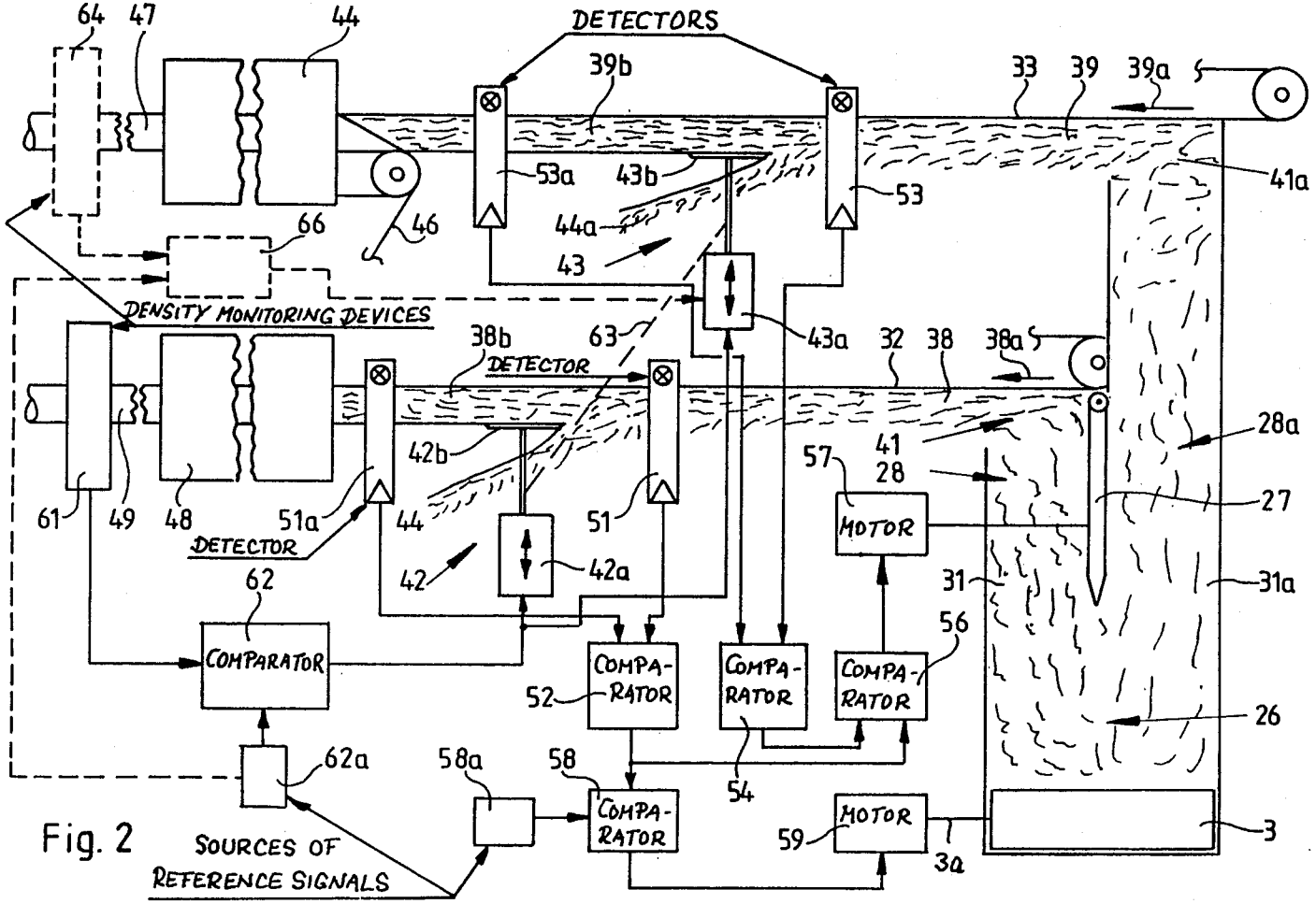
FIG. 2 is a diagram showing a presently preferred embodiment of the machine with one or more density monitoring devices.

As can be seen in FIG. 2, the lower reach of the conveyor 32 deflects the stream 28 so that the thus deflected stream 38 advances toward a trimming or equalizing station accommodating an adjustable surplus removing or trimming device 42. Analogously, the stream 28*a* is deflected by the lower reach of the conveyor 33 so that it forms a deflected stream 39 which is caused to advance toward a second surplus removing station accommodating an adjustable surplus removing or trimming device 43. The reference character 41 denotes in FIG. 2 a first deflecting or stream building station where the stream 28 is converted into the stream 38, and the stream 38 then advances in the direction which is indicated by arrow 38*a*. The reference character 41*a* denotes a second deflecting or stream building station where the stream 28 is converted into the stream 39, and the stream 39 then advances in the direction which is indicated by arrow 39*a*. The rate at which the adjustable component 3 of the withdrawing unit 2 shown in FIG. 1 removes fibrous material from the supply 1*a* in the duct 1 is such that not only the flow 26 but also each of the streams 28, 28*a* contains a certain minimum surplus of fibrous material or more than a minimum surplus. The surplus 44 is removed from the stream 38 by the rotary trimming element or elements 42*b* of the trimming device 42, and the surplus 44*a* is removed from the stream 39 by the rotary trimming element or elements 43b of the trimming device 43. The removed surplus 44 and the removed surplus 44a are conveyed or permitted to descend onto the vibratory trough-shaped conveyor 21 of the flow building means shown in FIG. 1, so that the surpluses 44 and 44a form the stream 19 which is merged into the flow consisting of lightweight particles 12 and 12a. The equalized stream 38 is converted into a rod-like filler 38b which is draped into a web (not shown) of suitable wrapping material (such as cigarette paper or the like) in a draping or cigarette rod forming unit 48. The resulting cigarette rod 49 contains the filler 38b and the web of wrapping material, and passes through a density monitoring means 61 on its way toward a conventional cutoff (not shown) which subdivides the rod 49 into a file of individual plain cigarettes of unit length or multiple unit length. Such cigarettes are ready to be admitted to storage, into the magazine of a packing machine or into a filter tipping machine. Analogously, the trimmed stream 39 constitutes a rod-like filler 39b which is draped into a web 46 of wrapping material (such as cigarette paper) in a draping means 44 of conventional design so that the resulting cigarette rod 47 can be subdivided into plain cigarettes of unit length or multiple unit length. The exact construction of the draping means 44 and 48, as well as of the means for cutting the cigarette rods 47 and 49 at desired intervals is well known in the art and need not be described here.

FIG. 2 shows the stream 38 at a level below the stream 39. The machine which embodies the structure of FIGS. 1 and 2 is preferably designed in such a way that the streams 38 and 39 are transported along their respective paths in directions indicated by arrows 38a, 39a but at the same level (see the left-hand portion of FIG. 1).

The machine of FIGS. 1 and 2 further comprises means for measuring the density of the tobacco stream 38 and of the rod-like filler 38b so as to enable a suitable circuitry, which will be described below, to ascertain the quantity of fibrous material which form the surplus 44. The measuring means comprises two detectors 51 and 51a. The detector 51 comprises a source of infrared light which is directed against successive increments of the advancing stream 38; and a suitable transducer located in the path of propagation of infrared light which has passed through and beyond the stream 38. The intensity of radiation which impinges upon the transducer is indicative of the density or mass of the respective increments of the stream 38. The detector 51a is of similar design; it comprises a source of infrared light at one side and a transducer at the opposite side of the respective portion of the path for the converted stream 38, namely for the rod-like filler 38b. The outputs of the detectors 51 and 51a are connected to the corresponding inputs of a signal comparing stage 52 which can constitute a quotient forming circuit of any known design. The output of the stage 52 transmits so-called surplus signals denoting the quantity of fibrous material in the surplus 44 which is being removed from the stream 38 in order to convert it into the filler 38b. An important advantage of a stage which constitutes a quotient forming circuit is that it eliminates the undesirable influences of certain variable parameters, such as changes of the mixture of particles which form the stream 38, changes of the color of particles and/or fluctuations of the blend of particles. The reasons for such elimination of undesirable variations of the just enumerated parameters are disclosed in several pending applications of the assignee of the present application.

The machine further comprises means for measuring the quantity of fibrous material which forms the surplus 44a. Such surplus is removed from the stream 39 so that the latter is converted into the filler 39b. A first detector 53 of the means for measuring the quantity of fibrous material in the surplus 44a is located upstream of the trimming device 43 and comprises a source of infrared light and a transducer which is connected to one input of a second signal comparing stage 54. A second detector 53a of the means for measuring the quantity of fibrous material in the surplus 44a is adjacent the path of movement of the filler 39b and comprises a source of infrared light and a transducer having its output connected to the other input of the signal comparing stage 54. The latter can be identical with the signal comparing stage 52, i.e., it can constitute a quotient forming circuit the output of which transmits so-called surplus signals denoting the quantity of particles which form the surplus 44a. The stages 52 and 54 can constitute commercially available prefabricated modules. Alternatively, the entire circuitry shown in FIG. 2 can be incorporated into a microprocessor.

The outputs of the stages 52 and 54 are connected to the corresponding inputs of a further signal comparing stage 56 wherein the two types of surplus signals are compared with each other and the output of the stage 56 transmits additional signals which are transmitted to a servomotor 57 serving as a means for adjusting the position of the partition (subdividing means) 27 so as to alter the mode of subdividing the flow 26 into the streams 28 and 28a. The servomotor 57 will change the position or inclination of the partition 27 when the characteristics of the surplus signal transmitted by the stage 52 deviate or depart from the corresponding characteristics of surplus signals transmitted by the stage 54. Adjustments of the partition 27 ensure that the quantity of surplus 44 as well as the quantity of surplus 44a will match a predetermined value. The predetermined value which is selected for the surplus 44 may but need not be identical with the predetermined value which is selected for the surplus 44a. In other words, it is not absolutely or invariably necessary that the quantity of fibrous material in the surplus 44 match the quantity of fibrous material in the surplus 44a.

The machine of FIGS. 1 and 2 further comprises means for ensuring that the flow 26, as well as each of the streams 28 and 28a, will invariably contain a predetermined minimum quantity of surplus tobacco. This is accomplished in that the output of one of the stages 52, 54 (see the stage 52 in FIG. 2) is connected with the corresponding input of a comparator circuit 58 another input of which is connected with the output of a source 58a of reference signals. The circuit 58 compares surplus signals from the stage 52 with reference signals from the source 58a, and its output transmits a signal when the surplus signals deviate from the reference signals. The signal at the output of the comparator circuit 58 is transmitted to an adjusting unit 59 (such as a variable-speed motor) for the speed of the aforementioned adjustable component 3 of the withdrawing unit 2 shown in FIG. 1. By changing the speed of the component 3, the unit 59 ensures that the minimum quantity of surplus in the flow 26 will not drop below a preselected value. The speed of the component 3 will be regulated with a view to ensure that each of the streams 28 and 28a will contain at least a predetermined minimum surplus of fibrous material. The speed of the component 3 is increased if the quantity of surplus in the flow 26 and/or in the streams 28, 28*a* descends to or below the predetermined minimum acceptable value, and the speed of the component 3 can be reduced if the quantity of fibrous material forming the surplus in the flow 26 exceeds a given value. The unit 59 is connected with the shaft 3*a* of the rotary component 3.

Successive increments of the cigarette rod 49 which is obtained as a result of draping the filler 38*b* pass through the density monitoring device 61 which can constitute a conventional beta-ray detector or a conventional X-ray detector. For example, the density monitoring device 61 can comprise a source of beta rays or other suitable corpuscular radiation at one side of the path of the rod 49, and an ionization chamber at the opposite side of the path of the rod 49. Beta radiation is directed against successive increments of the rod 49, and the intensity of radiation which has penetrated through the rod 49 and reaches the ionization chamber is indicative of the density of the respective increments of the rod 49. The ionization chamber transmits appropriate signals to a comparator 62 which compares the thus obtained signals with a reference signal transmitted by a source 62*a*. The output of the comparator circuit 62 transmits a signal to the adjusting means 42*a* and 43*a* of the trimming devices 42 and 43, respectively. The adjusting means 42*a* and 43*a* can constitute suitable motors which can raise or lower the trimming elements 42*b*, 43*b* to thereby change the rate of removal of fibrous material from the respective streams 38 and 39. The arrangement may be such that adjustments of the trimming element or elements 42*b* by the adjusting means 42*a* are synchronized with adjustments of the trimming element or elements 43*b* by the adjusting meand 43*a*. In other words, signals which appear at the output of the comparator circuit 62 can effect identical adjustments of the trimming devices 42 and 43.

The just described mode of adjusting the positions of trimming elements 42*b* and 43*b* exhibits the advantage that a single density monitoring device 61 suffices to bring about appropriate adjustments of both surplus removing or trimming devices (42 and 43). This is of particular importance if the density monitoring device contains a source of corpuscular radiation.

The just described means for adjusting the trimming devices 42 and 43 can be simplified still further by omitting one of the adjusting means 42*a*, 43*a* and by providing a rigid mechanical or other suitable connection between the trimming elements 42*b* and 43*b*. Such rigid connection is indicated in FIG. 2 by a broken line 63. It has been found that simultaneous adjustment of both trimming devices contributes significantly to the quality, especially to the uniformity or identity of characteristics, of the rods 47 and 49.

It is to be noted that the partition 27 constitutes but one of many available means for subdividing the flow 26 into a plurality of separate streams, such as the streams 28 and 28*a*. Other types of subdividing means are disclosed in commonly owned copending patent application Ser. No. 057,783 of Heitmann et al.

As indicated in FIG. 2 by broken lines, the improved machine can be equipped with an additional density monitoring device 64 which can but need not be identical with the density monitoring device 61. The device 64 monitors the density of successive increments of the rod 47 and transmits corresponding signals to a comparator 66 forming part of means for adjusting the trimming device 43 in response to density signals which are generated by the monitoring device 64. If the machine is equipped with the density monitoring device 64 and comparator 66, the operative connection between the output of the comparator 62 and the adjusting means 43*a* for changing the level of the trimming element or elements 43*b* can be omitted, the same as the rigid mechanical connection 63.

An advantage of discrete density monitoring devices for all of the rods is that the density of the rod 47 need not always match the density of the rod 49 and vice versa. Moreover, the provision of discrete monitoring devices for all of the rods ensures that the density of each rod will match or can match an optimum value, even if the operation of the trimming device 43 does not match the operation of the trimming device 42. In addition, this renders it possible to select an optimum quantity of surplus for removal by each of the trimming devices.

It is further possible to adjust the trimming device 42 and/or 43 in response to appropriate signals from the detectors 51*a* and 53*a*, i.e., in response to signals from detectors which are located downstream of the respective trimming devices. Signals which are transmitted by the detectors 51*a* and 53*a* and are used (if used) to adjust the trimming devices 42 and 43 can be influenced by signals from the density monitoring devices 61 and 64 so as to eliminate eventual undesirable influences of certain parameters of the fillers, such as changes of the type of tobacco, changes of the color of tobacco particles and/or others. Such undesirable parameters could adversely influence the optical density signals which are generated by the detectors 51*a* and 53*a*. The just discussed mode of regulating the density of cigarette rods is disclosed in commonly owned German patent application Ser. No. P 38 01 115.8 and in the corresponding U.S. patent application.

In each instance when the circuitry of the improved machine employs quotient forming circuits, it is equally possible (at least in certain instances) to employ differential circuits.

The detectors 51, 51*a*, 53 and/or 53*a* can be replaced with other types of detectors (for example, with detectors employing sources of beta rays, sources of other corpuscular radiation or X-rays) without departing from the spirit of the invention. The same applies for the density monitoring devices 61 and 64 at least one of which can be replaced with a density monitoring device employing a source of infrared rays or a source of other electromagnetic radiation.

An important advantage of the improved method and machine is that it is possible to simultaneously produce a plurality of identical or practially identical rods which contain tobacco or other fibrous material of the tobacco processing industry. As mentioned above, additional simplifications and savings in material, parts and initial maintenance cost can be achieved if the machine is equipped with a single density monitoring device and with means for adjusting the trimming devices for all of the streams in response to signals from such single density monitoring device. The improved method and machine further ensure that each of the streams carries a predetermined quantity of fibrous material. A single density monitoring device will suffice when it is desirable, advantageous and satisfactory to establish and maintain identical densities and identical quantities of surplus in each of the fiber streams.

It is already known to monitor the quantity of surplus which is removed from a single tobacco stream in a cigarette rod making or like machine. Reference may be had, for example to commonly owned U.S. Pat. No. 4,063,563 to Lorenzen which discloses a capacitive density measurement of a stream ahead of and downstream of the trimming station. Commonly owned U.S. Pat. No. 4,190,061 to Heitmann and commonly owned U.S. Pat. No. 4,236,534 to Heitmann et al. disclose means for optically measuring the height of the tobacco stream ahead of and downstream of the trimming station. The measuring means transmits signals to a circuit which calculates the quotient of such signals, the quotient being indicative of the quantity of removed surplus of tobacco. The rate at which tobacco is supplied to form the stream is determined by the intensity and/or other characteristics of signals which are generated in the aforedescribed manner in accordance with the teachings of Lorenzen, Heitmann and Heitmann et al.

Commonly owned U.S. Pat. No. 4,697,603 to Steinhauer et al. discloses a machine wherein the removed surplus is measured by a scale over which the surplus is caused to advance on its way back to the distributor or hopper of the cigarette rod making machine. Commonly owned U.S. patent application Ser. Nos. 07/150,526 and 07/152,951 disclose machines wherein the density of tobacco streams is measured upstream and downstream of the trimming station by optical measuring means, and the resulting signals are processed in order to generate signals which are indicative of the quantity of removed surplus.

Commonly owned copending patent application Ser. Nos. 760,995 of Radzio and 837,096 of Radzio et al. disclose optical density monitoring devices which operate with infrared rays.

The aforementioned commonly owned copending U.S. patent application Ser. No. 057,783 of Heitmann et al. discloses means for dividing a flow of fibrous material into a plurality of streams.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

I claim:

1. A method of simultaneously producing at least two rods from fibrous material of the tobacco processing industry, especially a plurality of tobacco rods for the making of cigarettes, comprising the steps of building a single flow of fibrous material; subdividing the flow into a plurality of streams each of which contains a surplus of fibrous material; removiang the surplus from each of the streams to thus convert the streams into rod-like fillers; measuring the quantities of removed surplus and generating surplus signals denoting the removed quantities; comparing with each other the signals which denote the removed quantities; and varying the subdividing step when the signals differ from each other until each of the streams contains a predetermined quantity of surplus.

2. The method of claim 1, further comprising the step of draping the fillers into webs of wrapping material.

3. The method of claim 1, further comprising the steps of monitoring the density of at least one of the fillers and generating a second signal denoting the monitored density of the at least one filler, and varying the removal of surplus from the respective stream as a function of changes of said second signal.

4. The method of claim 1, further comprising the steps of monitoring the density of only one of said fillers and generating a second signal denoting the monitored density, and synchronously varying the removal of surplus from all of the streams as a function of changes of the second signal.

5. The method of claim 1, further comprising the steps of measuring the density of each of the fillers and generating second signals denoting the densities of the respective fillers, and changing said surplus removing step as a function of changes of said second signals so that all of the fillers exhibit identical densities.

6. The method of claim 5, wherein said changing step includes comparing each second signal with a single predetermined reference signal and changing the rate of removal of surplus from a stream when the respective second signal deviates from the reference signal.

7. The method of claim 1, wherein said measuring step includes measuring the density of each stream prior and subsequent to removal of the surplus and generating first and second signals respectively denoting the densities prior and subsequent to removal of the surplus, and converting said first and the respective second signals into said surplus signals including forming quotients of the first and the respective second signals.

8. The method of claim 1, wherein said varying step includes forming additional signals denoting the differences between said first signal and utilizing said additional signals to divide the flow into said streams.

9. The method of claim 8, wherein the subdividing step includes breaking up the flow into streams which contain identical quantities of surplus.

10. Machine for simultaneously producing at least two rods from fibrous material of the tobacco processing industry, especially a plurality of tobacco rods for the making of cigarettes, comprising means for building a single flow of fibrous material; adjustable means for subdividing the flow into a plurality of streams each of which contains a surplus of fibrous material; means for conveying the streams along discrete paths in predetermined directions; discrete means for removing the surplus from each of the streams in predetermined potions of the respective paths to thus convert the streams into rod-like fillers; means for measuring the quantities of removed surplus including means for generating surplus signals denoting the removed quantities; means for comparing said surplus signals with each other for the presence of differences; and means for adjusting said subdividing means as a function of differences between said surplus signals until each of the streams contains a predetermined quantity of surplus.

11. The machine of claim 10, further comprising means for draping the fillers into webs of wrapping material.

12. The machine of claim 10, wherein said comparing means includes means for generating additional signals denoting the differences between said surplus signals, said adjusting means including means for utilizing said additional signals for adjustment of said subdividing means.

13. The machine of claim 12, wherein said comparing means comprises a differentiating circuit.

14. The machine of claim 12, wherein said comparing means includes a quotient forming circuit.

15. The machine of claim 10, wherein said surplus removing means are adjustable and further comprising means for monitoring the densities of fillers downstream of the respective surplus removing means and for generating density signals denoting the densities of the respective fillers, and means for adjusting said surplus removing means as a function of changes of the respective density signals so that all of the fillers exhibit identical densities.

16. The machine of claim 15, wherein said monitoring means comprises a discrete density monitoring device for each of the fillers, said means for adjusting said surplus removing means including at least one source of reference signals, means for comparing said density signals with reference signals from said source, and means for changing the rate of removal of surplus by the respective surplus removing means when density signals from a discrete density monitoring means deviate from said reference signals.

17. The machine of claim 16, wherein said means for adjusting said surplus removing means comprises a single source of reference signals common to all of said comparing means.

18. The machine of claim 10, wherein said surplus removing means are adjustable and further comprising means for monitoring the density of one of the fillers and for generating density signals denoting the density of the one filler, and means for adjusting all of the surplus removing means as a function of changes of said density signals.

19. The machine of claim 10, wherein each of said measuring means comprises first and second detectors arranged to monitor the density of the respective stream and the respective filler; and a discrete signal comparing stage connected with the first detector and the respective second detector and arranged to generate the corresponding surplus signal.

20. The machine of claim 19, wherein said measuring means further comprises means for comparing said surplus signals and for transmitting to said adjusting means additional signals denoting the differences between said surplus signals.

21. The machine of claim 20, wherein said means for comparing said surplus signals comprises a quotient forming circuit.

22. The machine of claim 19, wherein at least one of said detectors comprises a source of infrared light which is directed against the respective stream or filler.

23. The machine of claim 10, wherein said building means includes an adjustable component which is operative to vary the quantity of fibrous material in said flow, and further comprising means for adjusting said component in response to signals from at least one of said stages so that the flow and the streams contain at least predetermined minimum quantities of surplus.

24. The machine of claim 10, wherein said surplus removing means are adjustable and further comprising means for monitoring the density of at least one of said fillers and for generating density signals denoting the monitored density of the at least one filler, said monitoring means comprising a source of beta rays and further comprising means for adjusting at least one of said surplus removing means in response to variations of said density signals.

25. The machine of claim 10, wherein said surplus removing means are adjustable and further comprising means for monitoring the density of at least one of the fillers and for generating signals denoting the monitored density of the at least one filler, said monitoring means comprising a source of X-rays and further comprising means for adjusting at least one of said surplus removing means in response to variations of said density signals.

26. The machine of claim 10, wherein said adjusting means includes means for effecting a subdivision of the flow into equal streams through the medium of said subdividing means.

* * * * *